US006494952B1

(12) United States Patent
Mann et al.

(10) Patent No.: US 6,494,952 B1
(45) Date of Patent: Dec. 17, 2002

(54) DEVICE FOR APPLYING A THIN COAT ON THE SURFACE OF A SCREEN OF A CATHODE-RAY TUBE

(75) Inventors: Roland Mann, Stuttgart (DE); Wolfgang Schmutz, Zimmern (DE); Josef Gentischer, Remshalden (DE)

(73) Assignee: ACR Automation in Cleanroom GmbH, Niedereschach (DE)

( * ) Notice: Subject to any disclaimer, the term of this patent is extended or adjusted under 35 U.S.C. 154(b) by 0 days.

(21) Appl. No.: 09/529,413

(22) PCT Filed: Oct. 17, 1998

(86) PCT No.: PCT/EP98/06586

§ 371 (c)(1),
(2), (4) Date: Aug. 1, 2000

(87) PCT Pub. No.: WO99/22877

PCT Pub. Date: May 14, 1999

(30) Foreign Application Priority Data

Oct. 31, 1997 (DE) ..... 197 48 063

(51) Int. Cl.[7] ..... B05C 11/02; B05C 13/00; B05C 13/02

(52) U.S. Cl. ..... 118/52; 118/320; 118/500; 118/501; 118/503

(58) Field of Search ..... 118/52, 320, 500, 118/501, 503, 730; 427/162, 163.1, 163.2, 163.3, 163.4, 164, 165, 166, 167, 168, 169, 240, 425; 414/941

(56) References Cited

U.S. PATENT DOCUMENTS

| | | | | |
|---|---|---|---|---|
| 5,002,799 A | * | 3/1991 | Iwasaki | 427/72 |
| 5,234,499 A | | 8/1993 | Sasaki et al. | |
| 5,626,913 A | | 5/1997 | Tomoeda et al. | |
| 5,688,328 A | * | 11/1997 | Tong et al. | 118/505 |
| 5,902,648 A | * | 5/1999 | Naka et al. | 427/558 |
| 5,985,031 A | * | 11/1999 | Davis | 118/500 |

FOREIGN PATENT DOCUMENTS

| | | | | |
|---|---|---|---|---|
| DE | 1614216 B2 | | 5/1975 | |
| DE | 3932343 A2 | | 4/1990 | |
| JP | 63098933 A | * | 4/1988 | 118/320 |
| JP | 08069752 | | 12/1996 | |

* cited by examiner

*Primary Examiner*—Richard Crispino
*Assistant Examiner*—Kevin Shortsle
(74) *Attorney, Agent, or Firm*—Jones, Tullar & Cooper, P.C.

(57) ABSTRACT

An apparatus for applying a thin film of a liquid coating medium onto a curved surface of an article includes a receptacle for the article, a rotatably drivable turntable on which the receptacle is held and a nonrotatable process pot surrounding the receptacle and the turntable. A spray ring surrounds the surface to be coated and is retained at the open end of the process pot. It defines a central inflow opening. Several annular gaps are defined and the receptacle is provided with a suction cone. A laminar flow is aimed at the spray ring at the top of the process pot and the bottom of the process pot is joined to a suction flow.

26 Claims, 7 Drawing Sheets

DEVICE FOR APPLYING A THIN COAT ON THE SURFACE OF A SCREEN OF A CATHODE-RAY TUBE

TECHNICAL FIELD

The present invention relates to an apparatus for applying a thin film of a liquid coating medium onto a preferably curved surface of an article, preferably a glass bulb of a picture screen, having a rotatably drivable turntable on which a receptacle for the article to be coated is held fixed against relative rotation, a process pot held nonrotatably and surrounding the receptacle and the turntable, and a spray ring surrounding the surface to be coated and retained on the open end of the process pot.

PRIOR ART

In a known apparatus of this type, the glass bulb of a picture screen, for instance, is introduced into the process pot from the underside and pressed against a mask that surrounds the surface to be coated; the mask is intended to prevent the coating medium from reaching undesired regions of the glass bulb. This way of delivering and removing the glass bulb of the screen is mechanically complicated and inconvenient.

In another known apparatus, the glass bulb of the screen is introduced into the process pot from the top, and an open, split mask is brought in its closed position around the boundary edge of the surface to be coated. Once again, because of the split mask that has to be moved, this is mechanically complicated.

Both of the known apparatuses described have the common feature that especially at the edges of the surface to be coated, streaks and other discontinuities in the coating develop, unless special provisions for improved uniformity of the coating are made. This is the purpose of air guide elements placed against the corners of the mask in the known apparatuses. Nevertheless, such provisions do not prevent the flow from separating at the circumferential edges and becoming turbulent, which in turn means that the article to be coated becomes contaminated in undesired regions with the coating medium.

SUMMARY OF THE INVENTION

The object of the present invention is to provide an apparatus for applying a thin film to a surface of an article of the type described at the outset which is easier to handle as the article to be coated is being introduced and removed and which offers greatly improved uniformity of the film in the critical corner and edge regions of the surface to be coated.

To attain this object, in an apparatus for applying a thin film to an article as defined at the outset, the spray ring is provided with a central inflow opening and between the top part of the process pot and the spray ring, a first annular gap extending to beneath a fastening edge of the article to be coated on the receptacle is provided. The cross section of the annular gap is substantially less than an annular flow passage between the spray ring and the article to be coated retained in the receptacle. The receptacle is provided with a section cone which points toward a bottom of the process pot, and between which and an outer wall of the process pot there is a further annular gap and inside which a pressur relief chamber is formed. The pressure relief chamber is jointly defined by the bottom of the process pot. A laminar flow is aimed at the spray ring, or the top of the process pot, and the bottom of the process pot is joined to a suction flow.

By means of the provisions of the present invention, an air flow is produced which because of its different air velocities in various regions on the one hand makes the film to be applied uniform, even in the corner and edge regions of the preferably curved surface and on the other prevents contamination of other regions of the article to be coated. Because of the laminar flow in the region of the corners and edges of the preferably curved surface to be coated and because of the suction exerted on them toward the suction cone and the resultant downward-oriented flow component, on the one hand separation of the air flow at the edges and corners of the surface and thus turbulence are prevented, and on the other back spraying onto the surface to be coated is averted. In the further course of the air flow, more-effective suction of the atomized coating medium out of the critical region above the suction cone is achieved, after which the atomized coating medium can collect in the pressure relief chamber. In this region, the further gap prevents reverse turbulence in regions of the rotary bearings. On the other hand, the aspirated coating medium can be collected on the bottom of the process pot and removed by suction.

A vapor barrier from the pressure relief chamber to the bearing regions for the turntable is attained, without having to use vulnerable rotary seals and the pressure relief chamber is defined radially on the inside by an annular baffle between which and an inner wall of the process pot there is a third annular gap. It is expedient in this respect to secure the annular baffle to the underside of the turntable.

A process pot of low height is attained, which in its lower region surrounds the neck of, for instance, the glass bulb of the picture screen when the process pot is embodied cylindrically in its upper region and circularly-annularly in its lower region.

The outflow or removal by suction of the coating medium mist and/or coating medium droplets is advantageously achieved and the annular bottom of the process pot is curved in the circumferential direction and/or inclined in the radial direction and is joined to the suction flow via an opening in the region or regions of the lowest point or points.

To enable automatic or robot-controlled access to the article to be coated during its insertion and removal, the spray ring is retained in lowerable fashion on the process pot. Expedient features in this regard are obtained by the process pot having a removable top part, on which the spray ring is equipped retainers, which are distributed uniformly over the circumference and rest on one flange of the top part of the process pot, and is retained removably and which can be lowered into the bottom part of the process pot or can be lowered to below the upper end of the receptacle for the article to be coated. The result achieved is that the spray ring can be lowered down to or to below the height of the support of the article on the receptacle, so that the article to be coated can be grasped easily and moved through the spray ring.

In order, with the apparatus, to coat articles on their surface with the coating medium, such articles for instance being glass bulbs of pictures screens of various sizes or diagonal measurements, the receptacle for the article to be coated is retained interchangeably. Thus in an especially advantageous way, a receptacle suitable for a particular size of article to be coated can be retrieved from the process pot and replaced by a receptacle that can hold an article to be coated that is of different dimensions. Preferred features in this respect are obtained from the receptable being secured to the turntable and the turntable being interchangeably retained on a driven shaft which is hollow and is supported to rotate on a hollow stationary stand, which receives one end of the article to be coated and quick-action closures distributed uniformly over the circumference are provided between the turntable and one flange of the hollow shaft.

Thus in an especially advantageous way, a complete unit comprising the turntable, receptacle, suction cone and sealing cuff can be removed from the process pot and replaced by another one. To that end, the spray ring can be removed in a simple way from the top part of the process pot.

In a further feature of the present invention, the receptacle, on its support, is provided with a sealing cuff, which protrudes radially inward and on which a shoulder, remote from the surface to be coated, of the article to be coated rests sealingly. are provided, with which the surface to be coated of the article to be coated can be sealed off in a simple way from the other regions of the article to be coated. If the sealing cuff, in its radially inner region, is prestressed resiliently toward the article to be received a resiliently prestressed active contact of the sealing cuff with the shoulder of the article to be coated is achieved. The resilient prestressing can be achieved by means of concave curvature of the sealing cuff or by a kink provided along a circumferential line. To stabilize the sealing cuff, the sealing element rests on a resiliently prestressed lower part and is covered in the region of the fastening face by a retaining part so that the resilient prestressing is transmitted from a lower part onto the actual sealing element. In this respect, the sealing element protrudes radially inward past the resiliently prestressed lower part.

In a further feature of the present invention, provides the sealing cuff is fastened on the receptable by platelike components distributed over the circumference, and the platelike components are each provided with one protruding bolt, which bolts serve the purpose of detachable connection, in a manner fixed against relative rotation, to tabs disposed on a tension belt secured to the article on be coated which provides a fast and simple connection, in a manner fixed against relative rotation, attained between the article to be coated and the receptacle. Glass bulbs of picture screens, for instance, are provided on their circumference with a tension belt and retaining tabs secured to it, which are used for the aforementioned connection, in a manner fixed against relative rotation, with the bolts of the fastening plates.

Since the article to be coated on its surface is nonround, an example being a glass bulb of a picture screen which in plan view is rectangular with rounded corners, the corners located outside the inner circle meet the still air, so that in these corner regions severe turbulence and a shear flow arise, which carry the coating, already distributed outward by the spin coating process, still further away. To prevent this, and to improve the apparatus for the sake of uniformity of the film in the critical corner and edge region of the surface to be coated, in a variant the article to be coated on its surface, the surface being nonround in plan view, is at least partly surrounded by a guard baffle device is disposed sudstantially upright and extending to at least the plan of the surface to be coated.

Since essentially only the corner regions are threatened in this respect, is formed by individual guide baffles in the region of the corners of the articles the guide baffle device. It is expedient in this respect that the guide baffle, in terms of the direction of rotation, is disposed upstream in and downstream of the region of the corner, and the guide baffle portion upstream of the region of the corner is substantially longer than the guide baffle portion downstream of the region of the corner, because the side that is leading in the rotational direction relative to the corner region moves against the still air, while the trailing side is in the lee, as it were.

Thus with the aid of the guide baffle device, or the individual guide baffles, air turbulence can be kept away from the surface to be coated, for instance of the picture screen, to enable unhindered coating in the region of the corner.

To introduce and remove the article to be coated on its surface, retaining tabs are provided at the corners on the tension belt, as is realized for a glass bulb of a picture screen, for instance. To achieve the introduction and removal with the aid of a tool, such as a robot, it is possible that the guide baffle can be moved, for instant pivoted, out of the region of the corner of the article to bring the individual guide baffles out of this path of motion of the tool to the retaining tabs.

A simpler way of accomplishing access to the tool or robot to the individual retaining tabs in the corner region is obtained if the guide baffle device or guide baffle in the region of the corners or corner of the article has an outward-pointing recess surrounding a retaining tab of the article. With this baffle-like recess, constant access to the retaining tabs is assured, without requiring that the guide baffles be movable and without this recess having a negative effect on the guide baffle function.

A structurally advantageous embodiment is obtained by the guide baffle device or the individual guide baffles protruding past the surface to be coated.

Further details of the present invention can be learned from the ensuing description, in which the present invention is described and explained in further detail in terms of the exemplary embodiment shown in the drawing.

DESCRIPTION OF THE PREFERRED EMBODIMENTS

Figure 1:
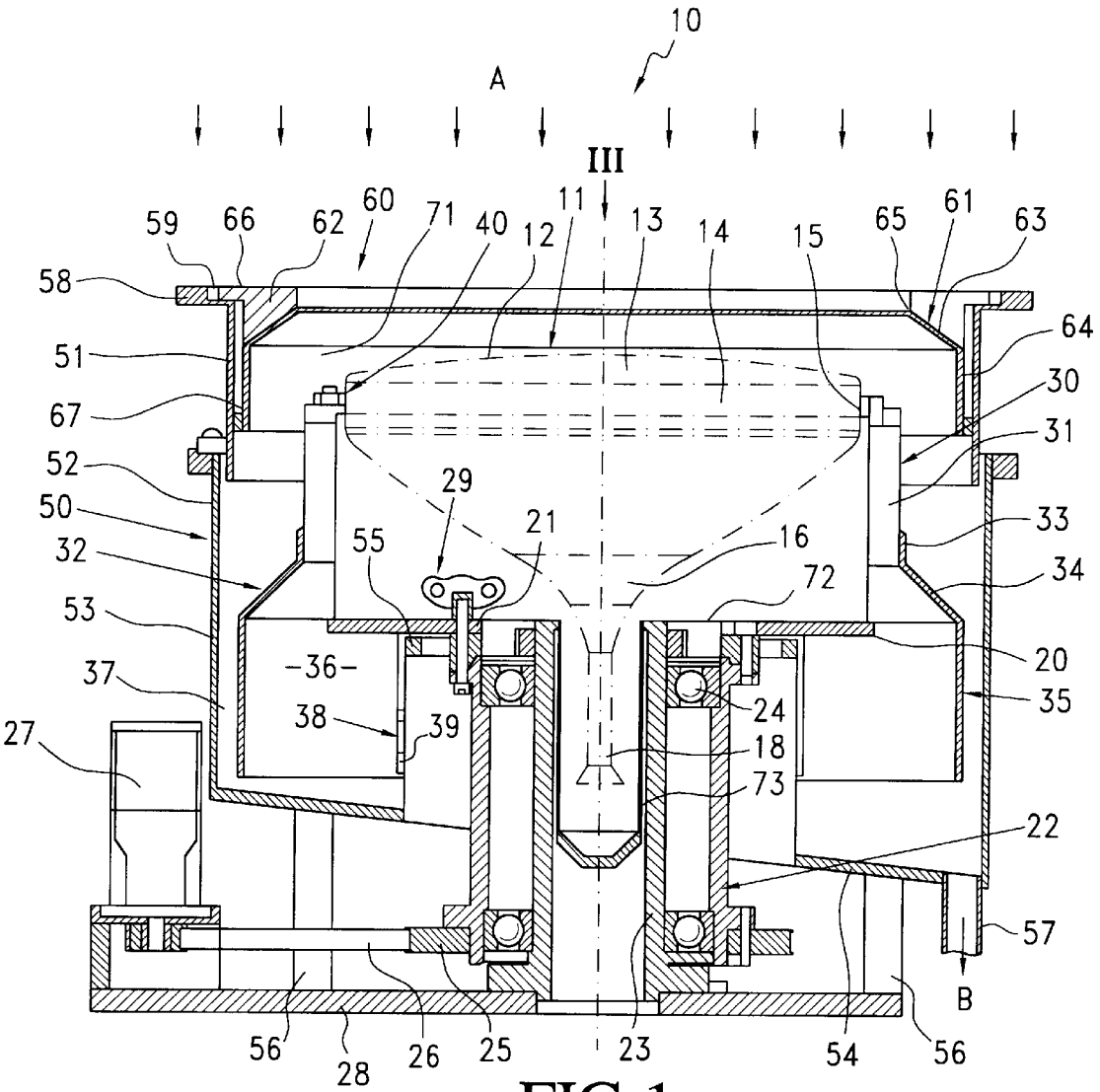
FIG. 1 is in a schematic longitudinal section, showing an apparatus for applying a thin film of a liquid coating medium onto a curved surface of a glass bulb of a picture screen in a coating position, in accordance with a preferred exemplary embodiment of the present invention.

The apparatus 10 shown in the drawing in terms of a preferred exemplary embodiment is used to apply a thin film of a liquid coating medium onto what here is a curved surface 12 of an article represented here by a glass bulb 11 of a picture screen. The application of the coating medium is done in the usual way via a spray arm, not shown here, over the surface 12 and, by centrifugal force distribution of the coating medium, along the surface 12 to be coated, or by spinning off the remaining coating medium by a rotary motion of the glass bulb 11 of the screen. While the surface 12 to be coated is being sprayed, the glass bulb 11 of the screen is driven at a relatively low rpm, while for centrifugal force distribution or for spinning the coating medium off along the surface 12 or past it, the rpm at which the glass bulb 11 of the screen is rotated is increased substantially.

The glass bulbs 11 of the screen to be coated are provided on their top 13 with a tension belt 14, on which circumferentially distributed retaining tabs 15 are provided that serve the purpose of retention both in the apparatus 10 and later in an equipment housing. Remote from the top 13 having the surface 12 to be coated, the glass bulb 11 of the screen has a neck 16.

The apparatus 10 has a receptacle 30 for the glass bulb 11 of the screen and also has a turntable 20, with which the receptacle 30 is connected in a manner fixed against relative rotation. The turntable 20 and the receptacle 30 are surrounded by a nonrotatably retained rotationally symmetrical process pot 50, which holds an upper spray ring 60 on its axially lowerable top part 51.

The turntable 20 can be connected to a flange 21 of a hollow shaft 22 in a manner that is fixed against relative rotation but is easily released. The hollow shaft 22 is rotatably held via roller bearings 24 on a concentric, stationary hollow shaft 23, and on its end remote from the flange 21 it has a pulley 25, which is fixed against relative rotation and is coupled via a drive belt 26 with the drive shaft of a drive motor 27, not shown in further detail. The hollow shaft 23 protrudes at right angles from an equipment base 28. The turntable 20 can be connected releasably to the flange 21 via quick-action closures 29, not shown in further detail.

The process pot 50 has an upper cylindrical pot part 52 inside which the top part 51 can be received in lowerable fashion, and a lower annular pot part 53, whose annular chamber is closed off by an annular bottom 54. The lower annular pot part 53 begins below the turntable 20 and has an inner annular flange 55, which in radially spaced-apart fashion surrounds the flange 21 of the hollow shaft 22 below the turntable 20. The process pot 50 is retained via its annular bottom 54 on legs 56 distributed over the circumference, which protrude at right angles from the base 28. At at least one point, the annular bottom 54 communicates via an opening with a suction neck 57, to which in a manner not shown a suction device is connected directly or indirectly. The annular bottom 54 is radially inclined toward the suction neck 57 and from a highest point extends in both circumferential directions downward toward the suction neck 57. The top part 51 of the process pot 50 can be lowered hydraulically, for instance, into the upper cylindrical pot part 52 and has an upper outer flange 58. The top part 51 is also retained in a manner not shown in further detail such that it can be removed or pulled out of the upper cylindrical pot part 52.

The spray ring 60 has a rotationally symmetrical hoodlike insert 61, which is removably held on the top part 51 of the process pot 50 via retainers 62, three of which, for instance, are distributed uniformly over the circumference. The retainers 62 are secured to a conical part 63, which changes over toward the bottom into a cylindrical part 64, along the circumference of a central opening 65 of the spray ring insert 61, an opening defined by the conical part 63. The retainers 62 are suspended by one arm 66 in a recess 59 of the outer flange 58 of the top part 51. Between the cylindrical part 64 of the spray ring insert 61, which is suspended from the top part 51, and the inside circumference of the top part 51 of the process pot 50, a first narrow annular gap 67 is formed.

The receptacle 30 has a boxlike receiving part 31, whose rectangular shape in plan view is approximately equivalent to the external dimensions of the top 13 of the glass bulb 11 of the screen. The receiving part 31 is seated on the top side of the turntable 20 and is joined to the turntable in a manner fixed against relative rotation. A suction cone 32 is provided in a manner fixed against relative rotation with the receiving part 31, whose external dimensions are markedly smaller than the inside diameter of the process pot 50 or its top part 51. The suction cone 32 has a circumferential flange 33, which is secured to the receiving part 31 and on which a hoodlike conical part 34 is firmly held that toward its end changes into a cylindrical part 35. The outer diameter of the cylindrical part 35 extending toward the annular 54 of the process pot 30 is such that there is a second annular gap 37 between the outer circumference of the cylindrical part and the inner circumference of the lower annular part 53 of the process pot 50. The cylindrical part 35 of the receptacle 30 ends at a certain distance from the annular bottom 54 of the process pot 50. Inside the cylindrical part 35, a pressure relief chamber 36 is formed, which is defined, away from the wall of the cylindrical part 35 in a radially inward direction, by a sheet-metal sleeve 38, which is retained in a manner fixed against relative rotation on the underside of the turntable 20 and between which and the inner wall of the lower annular pot part 53 a third narrow annular gap 39 is formed. A central opening in the bottom 72 of the receptacle 30 is adjoined by a tube 73, which is closed at the bottom and protrudes vertically downward, for receiving a thin end 18 of the glass bulb 11.

Figure 5:
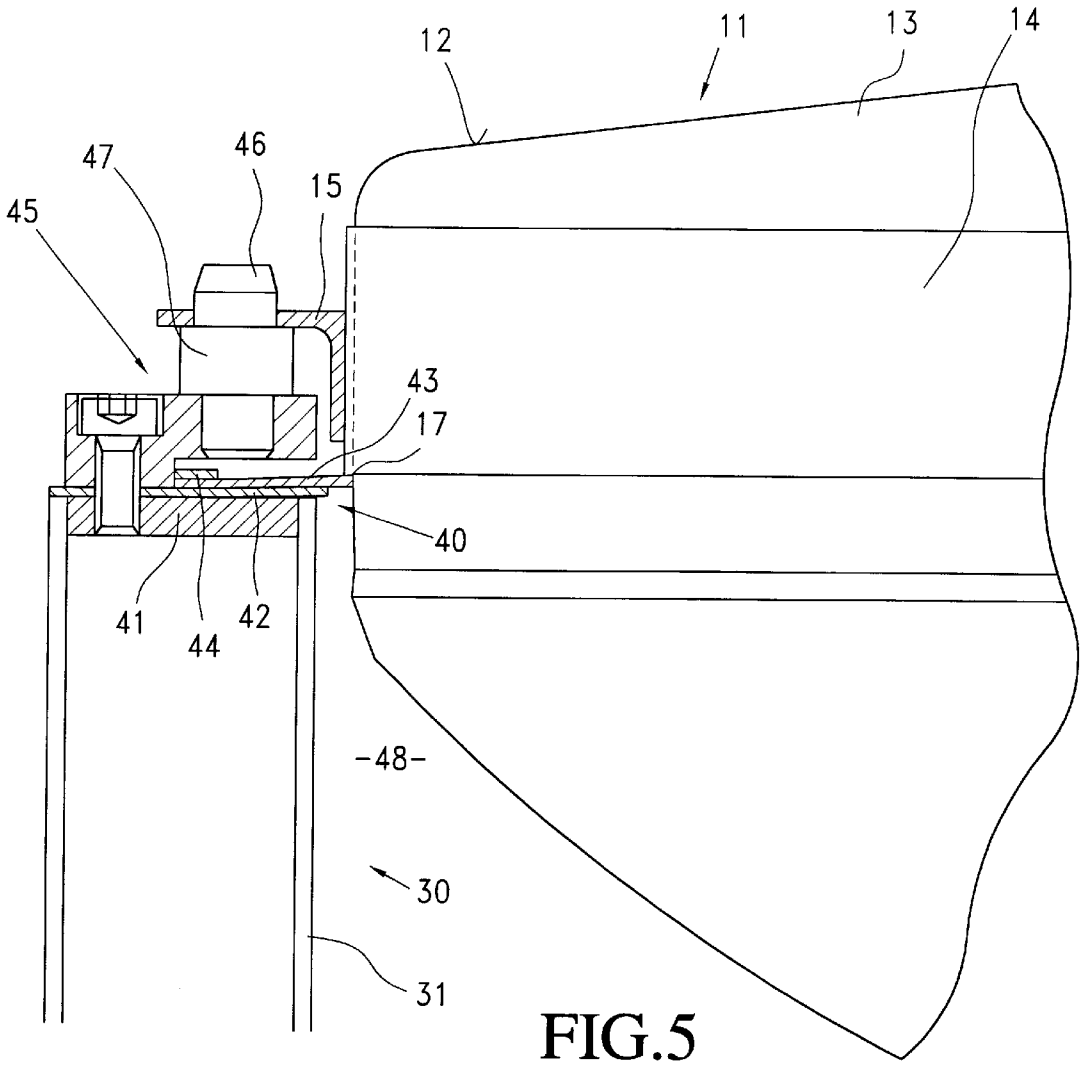
FIG. 5 is on a larger scale, a detail outlined by the circle V in FIG. 4.

The receptacle 30 or its receiving part 31 has an upper end face 41 extending all the way around, on which a sealing cuff 40 for the top 13 of the glass bulb 11 of the screen is secured. As shown in FIG. 5, the sealing cuff 40 has an elastically resiliently prestressed lower part 42, a flat seal 43, and a retaining part 44. The elastically resiliently prestressed lower part 42 is either curved or kinked toward the top in a radially inner region. The lower part 42, which reinforces the flat seal 43 and by its curvature lifts partway away from the end face 41, protrudes outward somewhat past the inner edge of the receiving part 31, while the flat seal 43 is drawn radially inward still farther. The retaining part 44, conversely, is substantially narrower; that is, it is located on the far side of the curved region of the lower part 42 only in the fastening region, where the sealing cuff 40 is firmly held, among other means by platelike components 45 distributed over the rectangular circumference, by means of screws. The platelike component 45, which is recessed in the curved inner region of the sealing cuff 40, is equipped, remote from where it is fastened to the receiving part 31, with a bolt 46 that protrudes upward and is provided with an annular collar 47; the glass bulb 11 of the screen is suspended from this bolt 46 by means of the retaining tabs 15 retained on the tension belt 14. In this suspended arrangement, as shown in FIG. 5, the lower end 17 of the retaining tab 15 presses against the inner edge of the flat seal 43, thereby sealing off the space 48 below the top 13 of the glass bulb 11 of the screen, or below the sealing cuff 40, from the coating medium.

The mode of operation of the apparatus 10 is as follows: In FIG. 1, the apparatus 10 is acted upon by a laminar flow represented by the arrows A that extends over the entire surface of the process pot 50; the laminar flow has a velocity of approximately 0.3 to 0.4 m/s, for example. In addition, as already noted above, a suction flow represented by the arrow B is generated in the suction neck 57 of the process pot 50.

During the spraying operation and in particular during the spinning operation, the laminar flow A passes through the central opening 65 to reach the surface 12 to be coated of the glass bulb 11 of the screen and moved past it into a passage 71 between the edges and corners of the glass bulb 11 of the screen and the conical part 63 of the spray ring 60. The laminar flow A also enters the first annular gap 67 between the spray ring insert 61 and the process pot top part 51. The partial flow through the first annular gap 67 is brought to a flow velocity between approximately 7 and 10 m/s as a result of this narrowed passage, thus exerting a pull, at the outlet of the annular gap 67, a pull on the partial flow in the passage 71. This has advantageous effects on the removal of the coating medium spun away from the peripheral and corner regions of the glass bulb 11, in such a way that there is no separation of the flow and hence no turbulence at the corners and edges of the glass bulb 11. This laminar flow that prevails overall leads to a very high degree of uniformity in the resultant film, including in the corner and peripheral regions of the glass bulb 11, thus preventing streaks or the like. The area of both the upper spray ring 60 and the first annular gap 7 between the process pot 50 and the upper spray ring 60, and also the area between the screen receptacle 30 and the upper spray ring 60, are dimensioned such that a downward-oriented flow component with air velocities between 7 and 10 m/s is generated at the circumference of the process pot 50. This also prevents back spraying onto the article 11. The free volume between the screen receptacle 30 and the process pot 50 is selected such that at spin speeds up to 250 rpm, no substantial dynamic pressure occurs in the region between the upper edge of the screen 11 and the suction cone 32.

The flow now enriched or atomized with coating medium, passes through the second annular gap 37 between the process pot 50 and the suction cone 32. This second annular gap 37 is selected such that a flow velocity of 3 to 5 m/s, for instance, is attained there, resulting in effective remove by suction of the atomized coating medium from the upper, critical region. In the further course of the downward-oriented flow, the flow leaves the second annular gap 37 to enter the pressure relief chamber 36, in which the in flowing coating medium mist is calmed by the reduction of the flow velocity to approximately 0.6 to 0.9 m/s. This allows a laminar inflow of the coating medium mist via the annular bottom 54 into the suction neck 57 on the one hand, and on the other, because of the third annular gap 39 which acts as a vapor barrier, penetration of this mist into the region of the turntable bearing is additionally prevented. This is attained both by the very slight cross section and by the considerable length of the third annular gap 39. In addition, the pressure relief chamber 36 causes settling of the mist, which then precipitates onto the inclined bottom.

Figure 2:
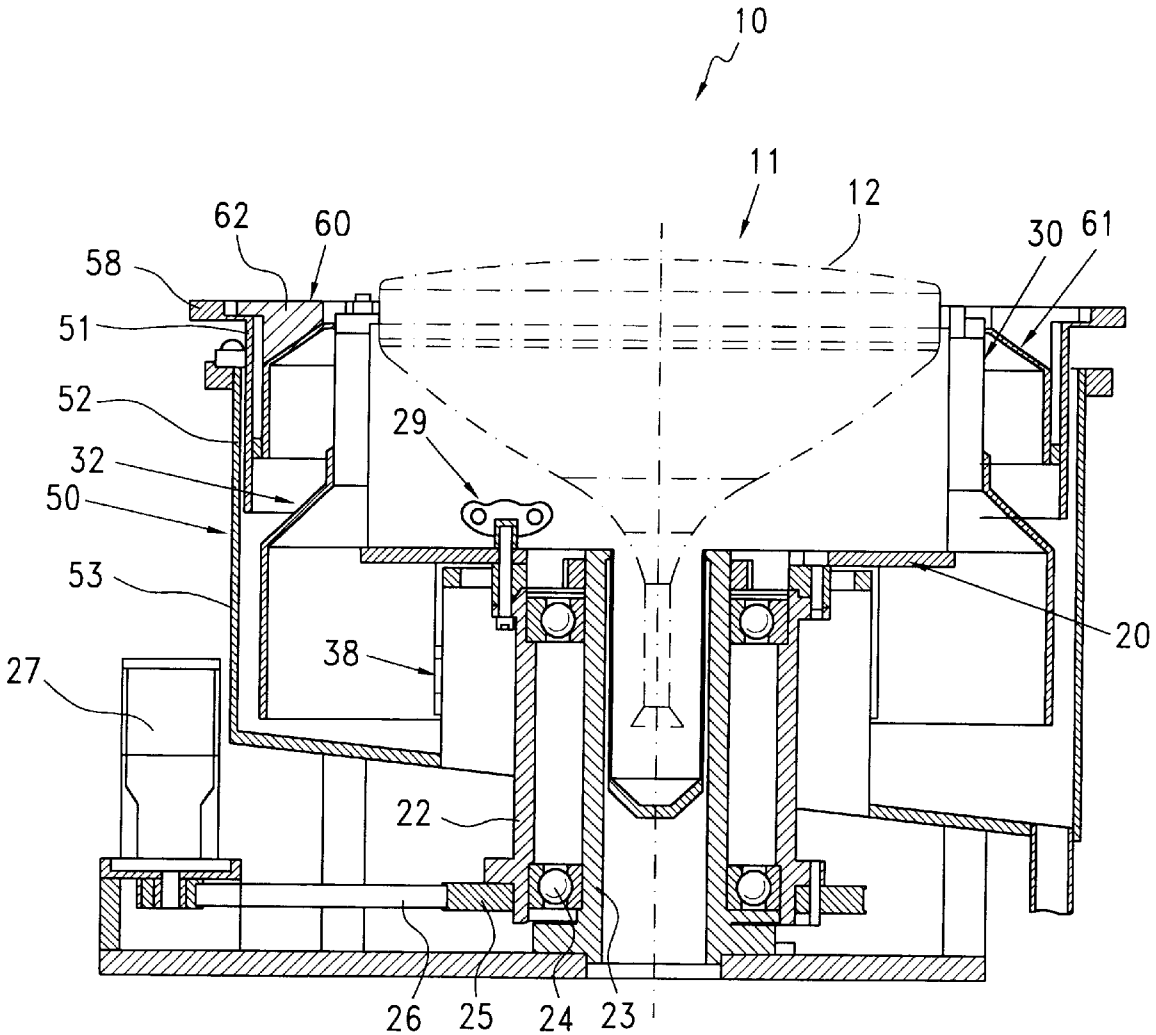
FIG. 2 is a view corresponding to FIG. 1, but in a position for changing the glass bulb of the picture screen to be coated.
Figure 3:
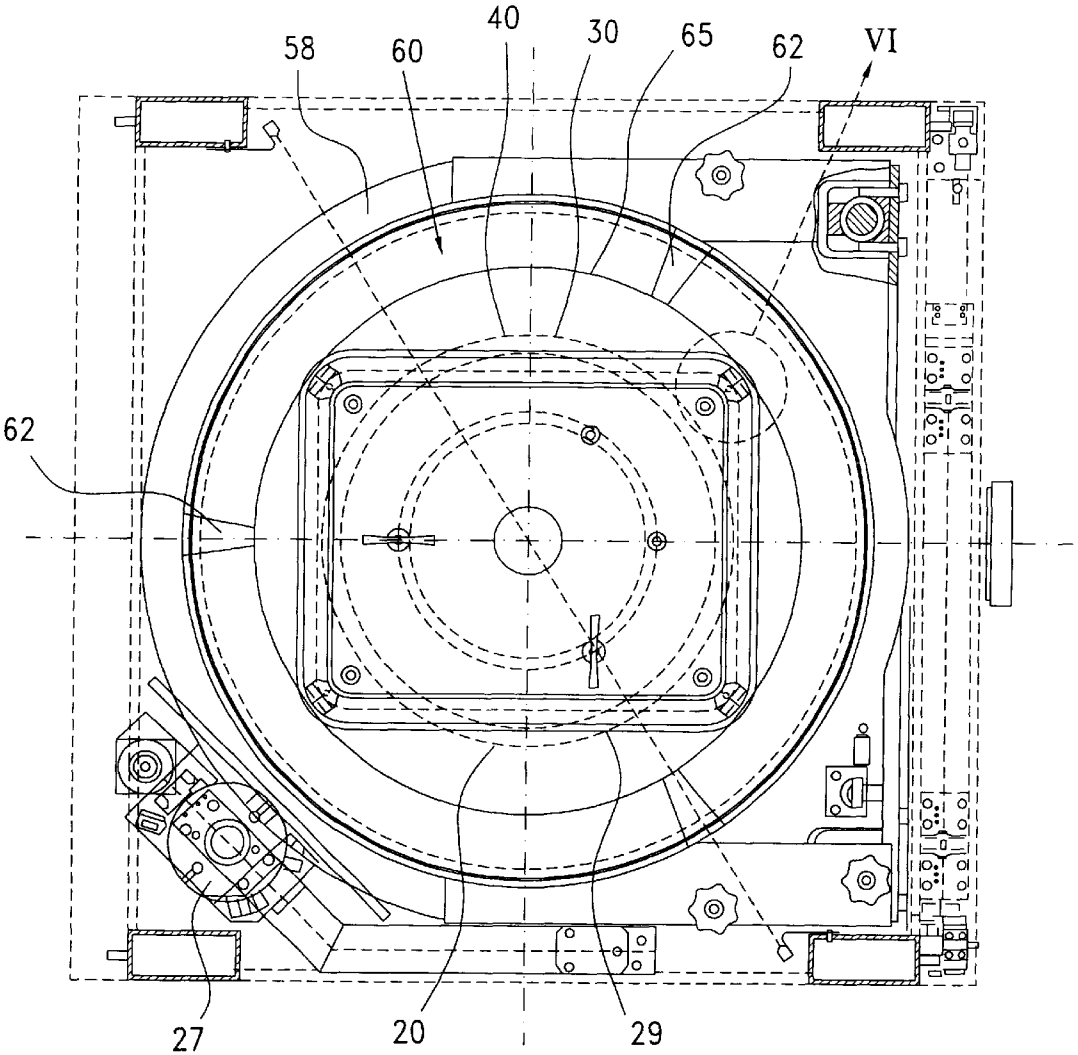
FIG. 3 is a schematic plan view in the direction of the arrow III of FIG. 1.

For replacing the glass bulb 11 to be coated, according to FIG. 2 the top part 51 of the process pot 50 is lowered together with the spray ring 60, so that with the aid of gripper arms, not shown, the glass bulb 11 can be grasped, for instance by the retaining tabs 15, and removed, and another glass bulb 11 can be inserted accordingly.

Figure 4:
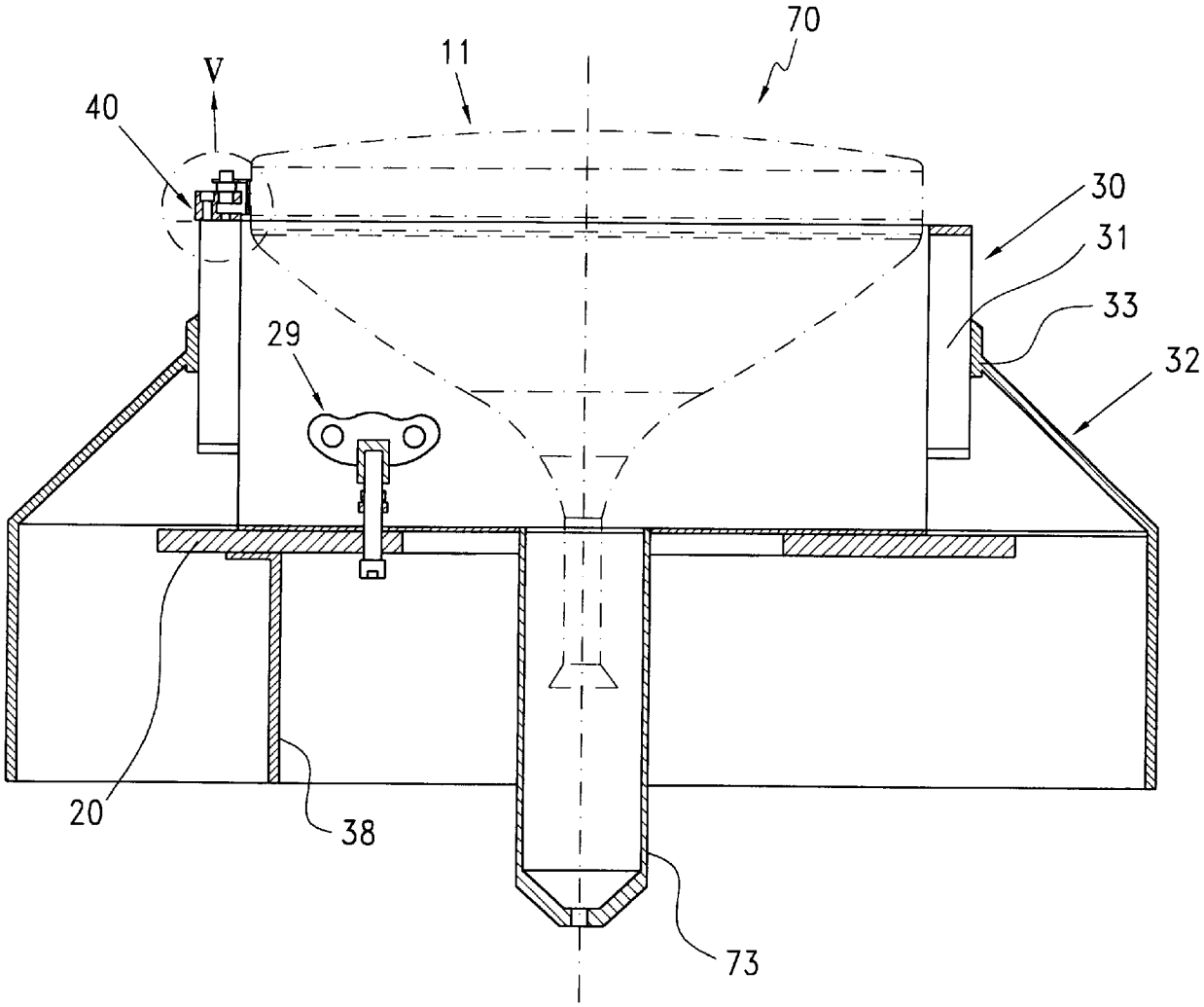
FIG. 4 is a schematic longitudinal section of an interchangeable unit for glass bulbs of picture screens of different sizes.

If the dimensions of glass bulbs 11 to be coated change, then the apparatus 10 can be adapted thereto in such a way that the unit 70 shown in FIG. 4, comprising the turntable 20 and receptacle 30 with the sealing cuff 40 is replaced wither another. This purpose is served by the quick-action closures 29, with which the turntable 20 can be releasably secured to the flange 21 of the hollow shaft 22. To remove such a unit 70, the spray ring 60 is removed from the top part 51, or depending on the diameter ratios between the top part 51 and the suction cone 32 of the receptacle 30, the top part 51 can optionally be removed along with the spray ring 60 from the process pot 50.

Figure 6:
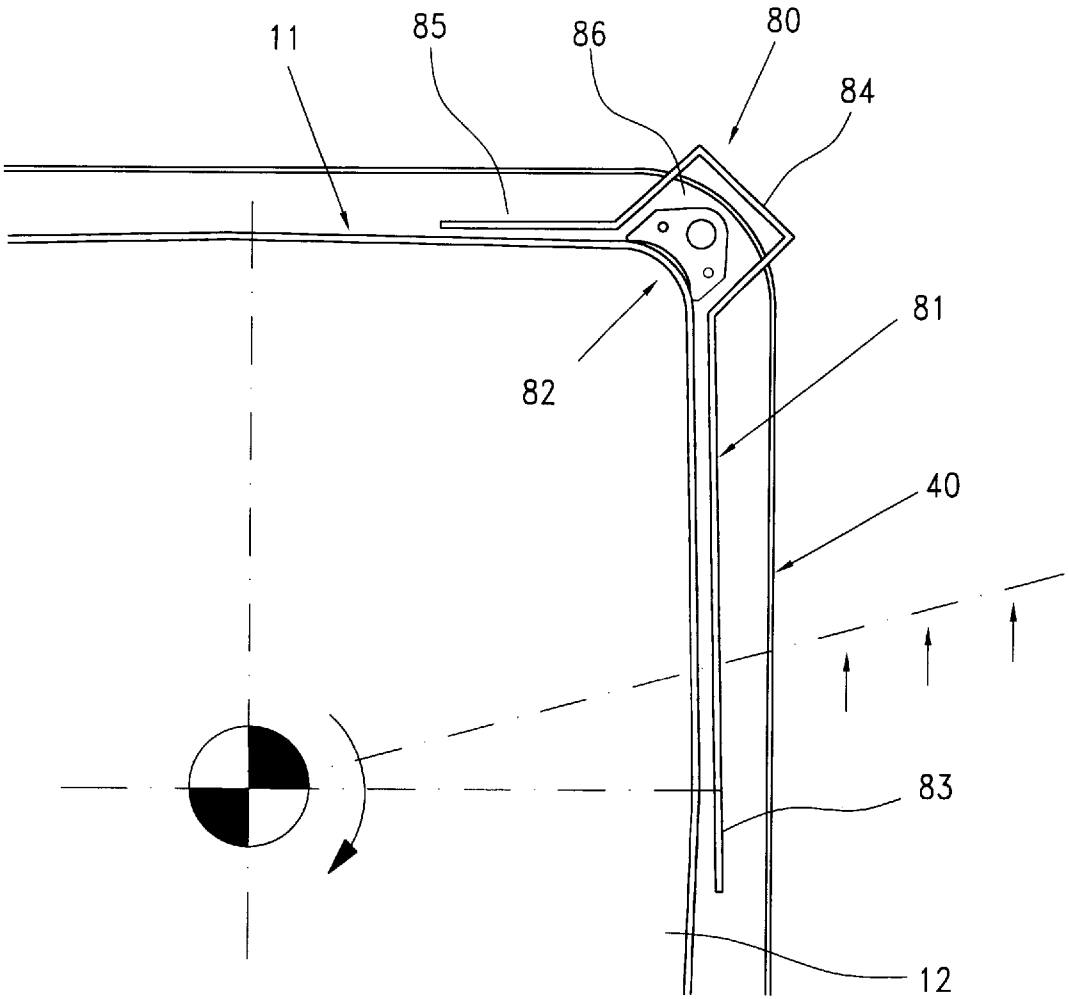
FIG. 6. on a larger scale, a detail outlined by the circle IV of FIG. 1, but in accordance with a variant.
Figure 7:
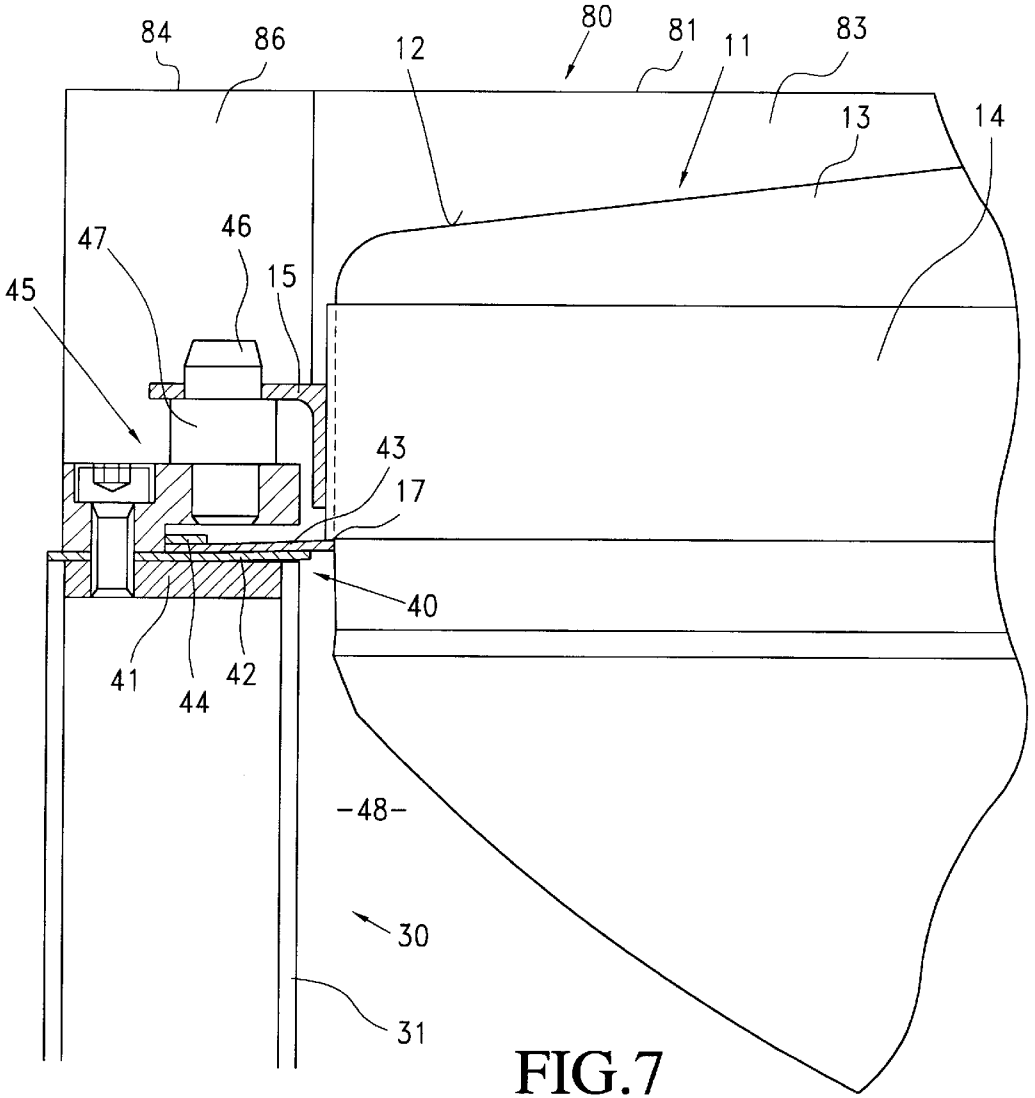
FIG. 7 is a view corresponding to FIG. 5 with the variant of FIG. 6.

In the variant shown in FIGS. 6 and 7, the apparatus 10 has a guide baffle device 80, which is disposed around the top region 13 of the glass bulb 11. The guide baffle device 80 is disposed upright and substantially parallel to the pivot axis of the turntable and thus to the axis of the glass bulb 11 of the screen and extends from a region at the level of the lower edge of the tension belt 14 upward to a vertical range of a few centimeters, for instance 5 cm, above the zenith of the curve surface 12 of the glass bulb 11 (FIG. 7).

The guide baffle device 80 comprises a plurality of individual guide baffles 81, in this case four of them, of which each guide baffle 81 is disposed in the region of one corner 82 of the top 13 of the glass bulb 11. The guide baffle 81 is in one piece and has a plurality of partial regions 83, 84 and 85. While the lateral partial regions 83 and 85 extend rectilinearly along and spaced slightly apart from the applicable sides of the top 13 or tension belt 14, the middle partial region 84 is recessed in baffle-like fashion in such a way that it surrounds the retaining tab 15, thereby creating a free space 86 inside the middle partial region 834 that allows free access to the retaining tab 15 by means of a tool or robot, for inserting and removing the article 11 into and from the apparatus 10 from above. In the exemplary embodiment shown, this recess 84 is rectangular, it is understood that it may also be in the form of a circular arc or the like. The particular partial region 83 of the guide baffle 81 that is leading in the rotational direction C of the turntable 20 is substantially longer than the partial region 85 that trails in that direction of rotation. For example, the leading partial region 83 extends over more than half the length of the applicable side of the top 13, while the trailing partial region 85 extends over only a small fraction, such as one-fourth, of the length of the applicable side of the top 13. With the aid of the guide baffles 81 mounted at the corners 82 of the glass bulb 11, it is possible to keep air turbulence away from the surface 12 to be coated of the glass bulb 11, and thus to attain an unhindered or uniform coating, even in the region of the corners 82.

In a variant of the guide baffle device 80 that is not shown, the individual guide baffles are provided extending linearly in every partial region, including in the middle partial region, along the outer edge of the top 13. In this variant, to gain access to the retaining tabs for inserting and removing the article 11, the individual guide baffles are movable or pivotable in such a way that access to the retaining tabs 15 can be enabled. This can be done for instance in such a way that the leading partial region of the guide baffle is connected pivotably by its free end.

What is claimed is:

1. An apparatus for applying a thin film of a liquid coating onto a curved surface of an article, the article having a fastening edge, the apparatus comprising:

a rotatably drivable turntable;

a receptacle for the article to be coated, said receptacle being mounted to said rotatably drivable turntable and fixed thereto against relative rotation, said receptacle being provided with a suction cone; and a nonrotatably mounted process pot which surrounds said rotatably drivable turntable and said receptacle, said nonrotatably mounted process pot defining an inner wall, an outer wall, an open end, and having a top part, a bottom part and a spray ring which surrounds the surface of the article to be coated, said spray ring being retained at the open end of said process pot, and being provided with a central inflow opening, wherein:

a first annular gap is defined between said spray ring and said top part of said nonrotatably mounted process pot, said first annular gap extending to beneath the fastening edge of the article;

an annular flow passage is defined between said spray ring and the article;

the cross section of said first annular gap being substantially less than that of said annular flow passage;

said suction cone points toward said bottom part;

a further annular gap is defined between said suction cone and said inner wall of said process pot; and a pressure relief chamber is situated within said suction cone and inwardly of said further annular gap, said pressure relief chamber being jointly defined by said bottom part and said suction cone.

2. The apparatus as defined in claim 1, further comprising:

an annular baffle, and wherein a third annular gap is defined between said annular baffle and the inner wall of said nonrotatably mounted process pot.

3. The apparatus as defined in claim 1, wherein said nonrotatably mounted process pot is cylindrical at its top part, and circular-annularly at its bottom part.

4. The apparatus as defined in claim 3, wherein said circular-annularly bottom part is one of curved in a circumferential direction, inclined in a radial direction, and curved in the circumferential direction and inclined in the radial direction.

5. The apparatus as defined in claim 1, wherein said spray ring is retained so as to be lowered on said nonrotatably mounted process pot.

6. The apparatus as defined in claim 5, wherein said top part of said nonrotatably mounted process pot is removable, said spray ring being retained to be removable and lowered into said bottom pail.

7. The apparatus as defined in claim 6, wherein said top part defines a flange, and wherein said spray ring is equipped with a plurality of retainers distributed uniformly over the circumference of said spray ring which rest on said flange.

8. The apparatus as defined in claim 5, wherein said spray ring is adapted to be lowered to below the upper end of said receptacle.

9. The apparatus as defined in claim 1, wherein said receptacle is retained to be interchangeable.

10. The apparatus as defined in claim 1, further comprising:

a driven shaft wherein said receptacle is secured to said turntable, and wherein said turntable is interchangeably retained on said driven shaft.

11. The apparatus as defined in claim 10, further comprising:

a hollow stationary stand, wherein said driven shaft is hollow and is supported to rotate on said hollow stationary stand, and wherein said hollow stationary stand receives one end of the article to be coated.

12. The apparatus as defined in claim 10, further comprising:

a plurality of quick-active closures distributed uniformly over the circumference of said turntable, wherein said hollow shaft has one flange, and herein said quick-active closures are provided between said turntable and said one flange of said hollow shaft.

13. The apparatus as defined in claim 1, wherein the article to be coated is provided with a shoulder remote from the surface to be coated, and wherein said receptacle is provided with a sealing cuff which protrudes radially inward on which the shoulder rests sealingly.

14. The apparatus as defined in claim 13, wherein said sealing cuff is resiliently prestressed in its radially inner region, toward the article.

15. The apparatus as defined in claim 13, wherein said sealing cuff is multilayered with an interposed sealing element.

16. The apparatus as defined in claim 15, wherein said sealing cuff has three layers.

17. The apparatus as defined in claim 15, further comprising:

a retaining part; and a resiliently prestressed lower part, wherein said sealing element defines a fastening face, and wherein said sealing element rests on said resiliently prestressed lower part and is covered in the region of said fastening face by said retaining part.

18. The apparatus as defined in claim 17, wherein said sealing element protrudes radially inward past said resiliently prestressed lower part.

19. The apparatus as defined in claim 13, further comprising:

a tension belt for securing the article to be coated; and a plurality of platelike components distributed over the circumference of said sealing cuff, wherein said sealing cuff is fastened on said receptacle by said platelike components, each platelike component being provided with one protruding bolt, and wherein said bolts serve the purpose of detachable connection, in a manner fixed against relative rotation, to tabs disposed on said tension belt.

20. The apparatus as defined in claim 1, comprising:

a guide baffle device, wherein the surface of the article to be coated is nonround in plan view, wherein the surface to be coated is at least partly surrounded by said guide baffle device and wherein said guide baffle device is disposed substantially upright and extends to at least the plane of the surface to be coated.

21. The apparatus as defined in claim 20, wherein said guide baffle device is formed by guide baffles in a region of a corner of the article.

22. The apparatus as defined in claim 21, wherein in terms of the direction of rotation, said guide baffle device is disposed upstream and downstream of the region of the corner, and wherein a portion of the guide baffle device upstream of the region of the corner is substantially longer than a portion of the guide baffle device downstream of the region of the corner.

23. The apparatus as defined in claim 21, wherein said guide baffles can be moved out of the region of the corner.

24. The apparatus as defined in claim 23, wherein said guide baffles are pivoted.

25. The apparatus as defined in claim 21, wherein one of: said guide baffle device and said guide baffles has an outward-pointed recess in the region of the corners of the article, surrounding a retaining tab of the article.

26. The apparatus as defined in claim 21, wherein: said guide baffles protrude past the surface to be coated.

* * * * *